US010577941B2

(12) United States Patent
DeFilippis

(10) Patent No.: US 10,577,941 B2
(45) Date of Patent: Mar. 3, 2020

(54) AXIAL FAN

(71) Applicant: SPAL AUTOMOTIVE S.r.l., Correggio (RE) (IT)

(72) Inventor: Pietro DeFilippis, Varazze (IT)

(73) Assignee: SPAL AUTOMOTIVE S.R.L., Correggio (IT)

( * ) Notice: Subject to any disclaimer, the term of this patent is extended or adjusted under 35 U.S.C. 154(b) by 69 days.

(21) Appl. No.: 15/747,717

(22) PCT Filed: Aug. 5, 2016

(86) PCT No.: PCT/IB2016/054744
§ 371 (c)(1),
(2) Date: Jan. 25, 2018

(87) PCT Pub. No.: WO2017/021935
PCT Pub. Date: Feb. 9, 2017

(65) Prior Publication Data

US 2018/0216470 A1 Aug. 2, 2018

(30) Foreign Application Priority Data

Aug. 5, 2015 (IT) ..... 10201542248

(51) Int. Cl.
*F04D 29/32* (2006.01)
*F01D 5/16* (2006.01)
*F04D 29/66* (2006.01)

(52) U.S. Cl.
CPC ..... *F01D 5/16* (2013.01); *F04D 29/329* (2013.01); *F04D 29/668* (2013.01); *F05D 2240/30* (2013.01); *F05D 2300/501* (2013.01)

(58) Field of Classification Search
CPC ..... F04D 29/34; F04D 29/023; F04D 29/322; F04D 29/329; F04D 29/328; F04D 19/002; F04D 29/32; F01P 5/06; F01P 11/10
See application file for complete search history.

(56) References Cited

U.S. PATENT DOCUMENTS 3,407,882 A 10/1968 Wooden et al.
3,782,853 A * 1/1974 Frister ..... F04D 29/287 416/132 R (Continued)

FOREIGN PATENT DOCUMENTS

CN 101265920 A 9/2008
CN 102597531 A 7/2012

(Continued)

OTHER PUBLICATIONS

International Search Report and Written Opinion dated Oct. 18, 2016 for counterpart PCT Application No. PCT/IB2016/054744.

(Continued)

*Primary Examiner* — Richard A Edgar
*Assistant Examiner* — Maxime M Adjagbe
(74) *Attorney, Agent, or Firm* — Shuttleworth & Ingersoll, PLC; Timothy J. Klima

(57) ABSTRACT

An axial fan includes a motor, an impeller and a hub of the impeller for connecting to a shaft of the motor. A bottom wall of the hub has a central portion and an outer annular portion connected to the central portion by an intermediate portion defined by a plurality of blades arranged radially and angularly distributed about an axis of rotation. The blades are elasto-plastic blades and are able to prevent the impeller from moving axially parallel to the axis, moving radially perpendicular to the axis and a bending of the impeller with movements normal to the plane in which the mean surface of the impeller itself lies. The blades allow a movement with (Continued)

torsional bending around the axis to allow the damping of the resonance frequencies of the assembly formed by the impeller-shaft-rotor.

8 Claims, 7 Drawing Sheets

(56) References Cited

U.S. PATENT DOCUMENTS

| | | | | |
|---|---|---|---|---|
| 4,193,740 | A | 3/1980 | Charles | |
| 6,790,006 | B2 | 9/2004 | Robb | |
| 7,585,159 | B2 * | 9/2009 | Caplan | F01D 5/34 416/169 A |
| 2004/0223845 | A1 | 11/2004 | Caplan et al. | |
| 2012/0201705 | A1 * | 8/2012 | Spaggiari | F04D 29/263 417/423.14 |

FOREIGN PATENT DOCUMENTS

| | | | |
|---|---|---|---|
| EP | 0168594 | A1 | 1/1986 |
| EP | 1375923 | A2 | 1/2004 |
| EP | 1892421 | A2 | 2/2008 |
| GB | 1464559 | A | 2/1977 |
| JP | H0779539 | | 3/1995 |

OTHER PUBLICATIONS

Chinese Office Action dated Apr. 29, 2019 for counterpart Chinese Patent Applicaiton No. 201680045593.0.

* cited by examiner

AXIAL FAN

This application is the National Phase of International Application PCT/IB2016/054744 filed Aug. 5, 2016 which designated the U.S.

This application claims priority to Italian Patent Application No. 102015000042248 filed Aug. 5, 2015, which application is incorporated by reference herein.

TECHNICAL FIELD

This invention relates to an axial fan and, in particular, to an axial electric fan for automotive applications.

The prior art fans, to which reference is made in this specification, comprise an axial fan and an electric motor which drives the fan and are usually referred to as "axial electric fans".

BACKGROUND ART

The electric motor has a substantially cylindrical casing, a stator unit and a rotor unit, housed inside the casing and coupling means designed to couple the rotor unit to the impeller so as to rotate it.

The above-mentioned coupling means are normally defined by a shaft protruding from the casing, rotated by the rotor unit.

In this description, for sake of simplicity, reference will always be made to the fact that the above-mentioned coupling means comprises a shaft protruding from the casing of the electric motor and rotated with the rotor unit, but without limiting the scope of the invention.

The impeller has a connecting hub coaxial with the shaft of the motor and a plurality of blades extending radially from the hub.

Usually, the hub of the impeller is cup shaped, that is to say, it has a bottom wall facing the wall of the motor from which the shaft projects, for connecting to the shaft of the motor, and a substantially cylindrical lateral wall from which the blades extend.

In order to limit the axial dimensions of the "axial electric fan" unit, the motor is at least partly housed inside the hub, surrounded by the lateral wall of the hub itself which, starting from the bottom wall, extends towards the motor.

Again with the aim of reducing as much as possible the size of the "axial electric fan" unit, electric motors of the "brushless" type are used, which have axial dimensions (thickness) which are relatively limited.

Moreover, during the design stage the distance between the bottom wall of the hub and the front wall of the electric motor facing the bottom wall of the hub is limited as much as possible.

Lastly, a tubular gap is defined between the motor casing and the hub of the impeller, that is, between the casing and the lateral wall of the hub, to allow the impeller to rotate freely.

The use of so-called "flat motor fans", that is to say motors with limited axial thickness characteristics, is a beneficial factor of the axial electric fan unit since the space available in the engine compartment of modern cars is increasingly limited. In this regard, it should also be noted that, although "brushless" electric motors are used, the majority of the space of an axial electric fan is occupied by the electric motor itself, so, even if a large part of the motor is inside the hub, in order to contain the axial dimensions of the electric fan unit it is necessary to reduce the axial dimensions of the impeller.

However, since the axial dimensions of the impeller (its thickness) cannot be reduced below a certain structural limit, especially for high outputs wherein the impellers have very large diameters, in order to attempt to limit as much as possible the axial dimensions of the electric fan it is necessary to reduce as much as possible the distance between the bottom wall of the hub and the surface of the motor facing the bottom wall of the hub itself.

It should be noted that the distance becomes a critical point of the design and tends to become increasingly reduced.

It should also be noted that the shaft must protrude from the motor for a sufficient stretch in such a way that it can couple to the fan with mechanical safety.

In this regard, at the central point of keying the shaft to the hub, the bottom wall of the latter is equipped with a sintered steel bushing co-moulded with the bottom wall. This technology also makes it possible to reduce the distance between the bottom wall of the hub and the wall of the motor facing the bottom wall of the hub.

In addition to drawbacks mentioned above relative to the axial dimensions, which will be discussed further below, the electric fan unit and, more specifically, the rotor and impeller, have vibration problems.

It is known that the impellers of axial fans driven by electric motors (of any type: brushless, DC etc.) generally have a problem of transmission by the motor to the impeller of a torque ripple having a frequency which is generally a multiple of the number of revolutions of the motor, which is superposed on the desired continuous torque.

In other words, no type of electric motor generates a constant torque, but always has a variable "parasite" component which is superposed on the constant component. The"parasite" component is precisely the above-mentioned torque ripple. These torque ripples have a frequency which is generally a multiple of the speed of rotation of the motor. It follows that these frequencies change with the speed of the motor. If the rotor and impeller unit has a relative resonance frequency it means that there will be a certain predetermined speed of the motor at which the above-mentioned torque ripple has a frequency which is exactly the resonance frequency.

It therefore follows that the torque ripple generates its maximum damage when its frequency generates resonance of the elastic/inertial system consisting usually of the drive shaft (the so-called torsional spring) and the moments of inertia of the rotor of the motor and of the impeller.

In conclusion the so-called torque ripple induces vibration phenomena amplified at the resonance frequency of the impeller unit, shaft, motor rotor which in turn generate unwanted and unacceptable acoustic noise effects.

Use is known, in the prior art, of traditional dampers made of rubber interposed in various shapes and sizes between the motor and the impeller.

Reference is made in this regard to the patent publications GB 1464559; U.S. Pat. No. 4,193,740; EP1375923.

With reference to the above description regarding the need to reduce the axial dimensions of the electric fan unit, one must conclude that the use of the latter for cooling heat exchangers in the automotive sector results in a series of limitations which means that the use of the traditional damping structures described above is not practical to resolve the above-mentioned noise problem.

As mentioned above, the market request for minimum axial length of the electric fan unit provides only a few millimetres of motor shaft to couple the impeller to the motor and in particular the reduced distance between the bottom wall of the hub and the wall of the motor facing the bottom wall of the hub does not allow the use of traditional rubber dampers.

In addition, the impellers are made of a plastic material and must comply with specifications and withstand vibration tests and gyroscopic effects which require significant rigidity in an axial and radial direction and bending which is generated on the plane in which the impeller itself lies.

For this purpose, the above-mentioned impellers also contain a significant percentage of glass fibres (typically 35%) which tends to increase their rigidity.

The fact of reducing the distance between the bottom wall of the hub and the wall of the motor and the possible use of rubber "dampers" would reduce the rigidity of the impeller to the above-mentioned axial and bending forces and would introduce movements of the impeller during its operation which would cause the impeller to slide against the other parts present in the motor compartment of the motor vehicles or even against the supporting structure (shroud) of the impeller itself.

It should also be noted that the gyroscopic effect is very strong. The impeller is subjected to a torque force on its plane which if it were not rigid would have all the problems indicated above.

In other words, the impeller must absolutely not move or bend relative to its position adopted on the plane in which it lies because the spaces for bending are small and it would tend to touch other parts present in the motor compartment and break.

Moreover, the specifications due to environmental requirements and the reliability/life of the product are very stringent. For example, the impellers must be able to operate with operating temperatures ranging from −40° to +150° (ambient degrees) and must withstand all external agents such as petrol, oil, water, salt water, and other chemical components.

Also for these reasons, rubber is absolutely unsuitable for being used to make damping devices or structures.

In this context, the main aim of this invention is to overcome the above-mentioned drawbacks.

DISCLOSURE OF THE INVENTION

The aim of this invention is to provide an axial electric fan which is free of the problem of noise introduced by the resonance frequencies.

Another aim of this invention is to provide a fan unit which allows the same rigidity to be maintained against axial and radial movements and bending, generating a damping effect for the stresses due to the above-mentioned ripple torques.

The technical purpose indicated and the aims specified are substantially achieved by an axial fan according to the present disclosure.

BRIEF DESCRIPTION OF DRAWINGS

Further features and advantages of this invention are more apparent in the detailed description below, with reference to a preferred, non-restricting, embodiment of an axial fan as illustrated in the accompanying drawings, in which.

DETAILED DESCRIPTION OF PREFERRED EMBODIMENTS OF THE INVENTION

Figure 1:
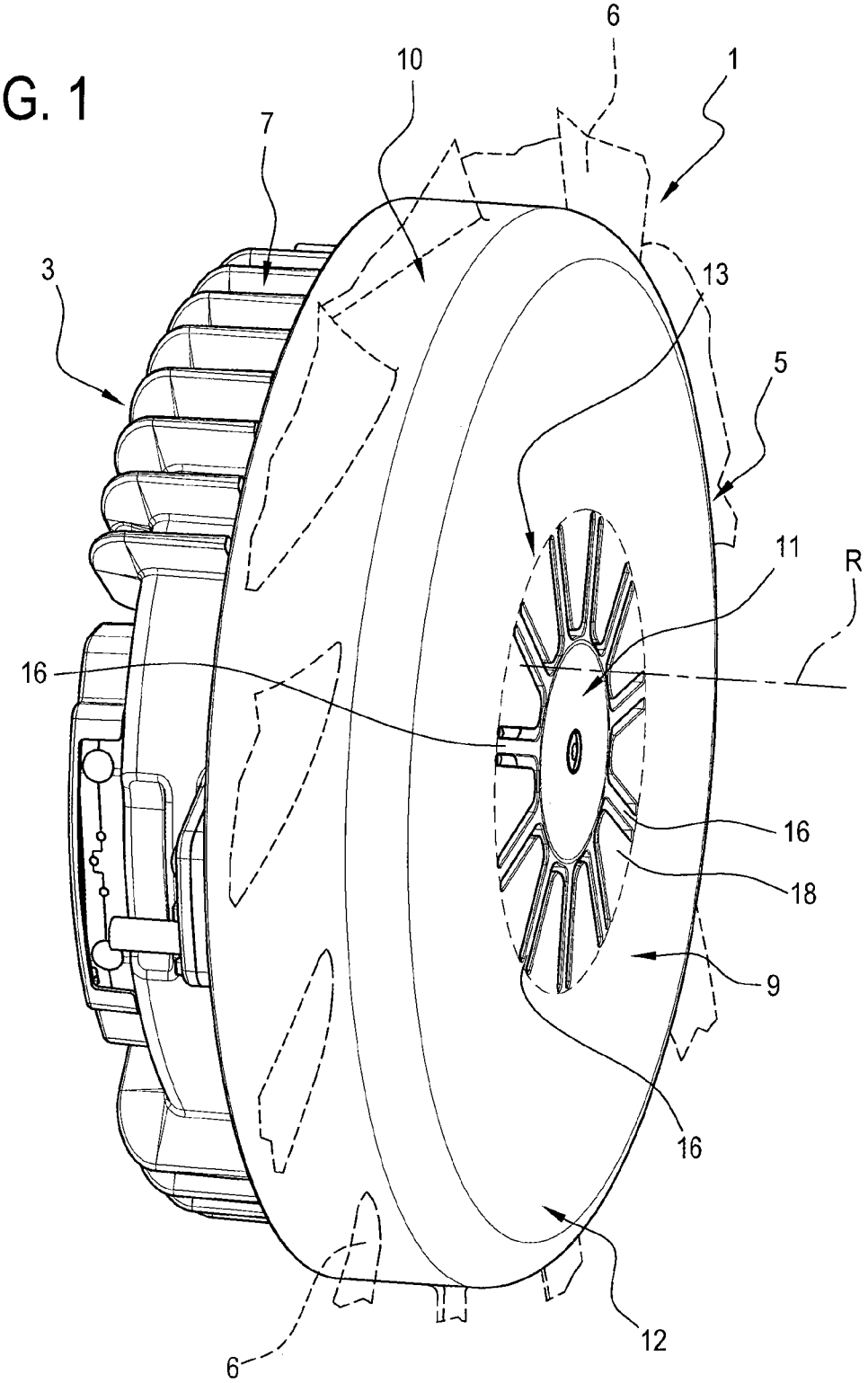
FIG. 1 shows a schematic perspective view of an axial fan according to this invention, equipped with an electric motor and without the view of the blades.
Figure 2:
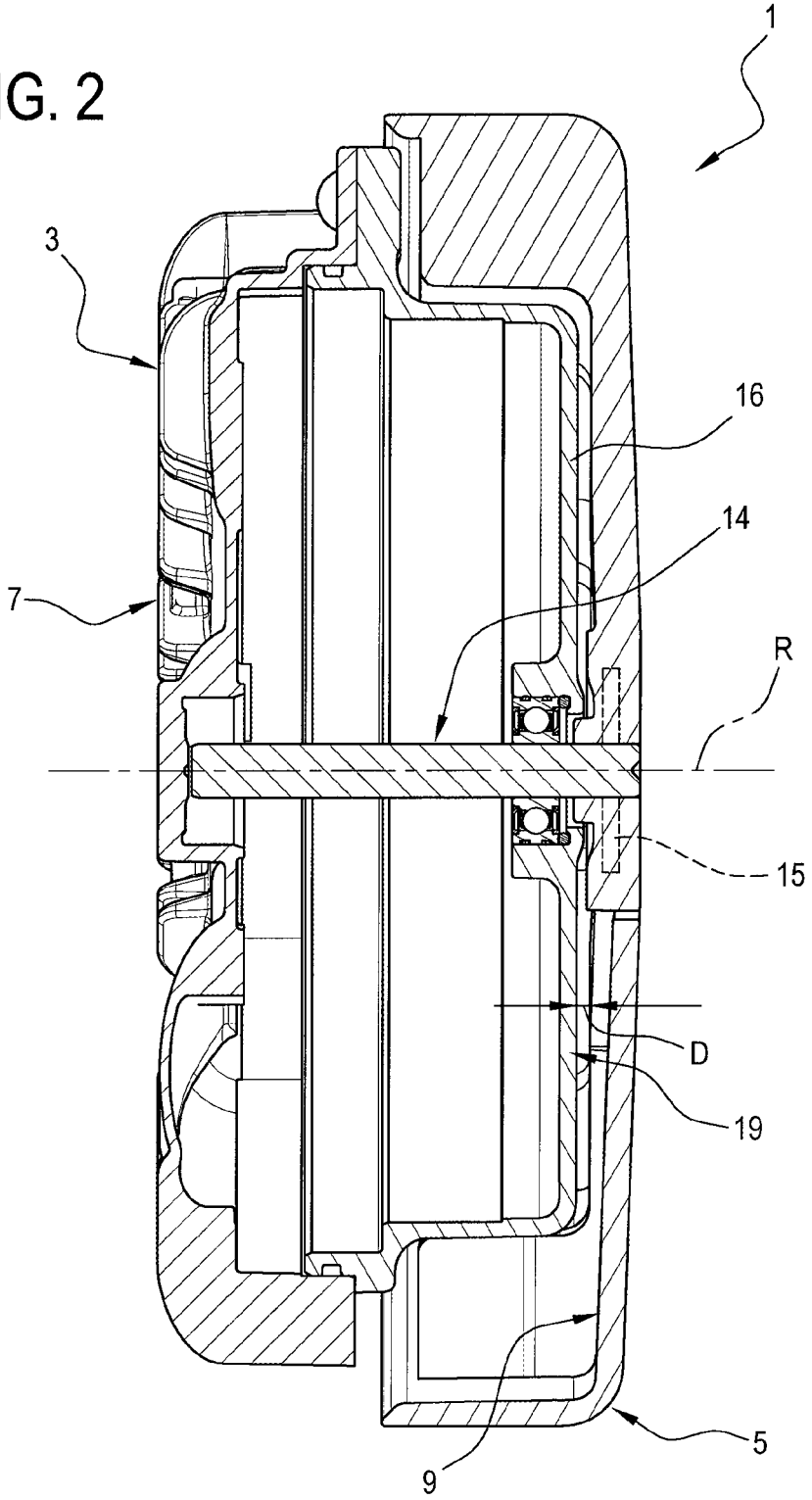
FIG. 2 shows a schematic radial cross section view of the axial fan of FIG. 1.

With reference to the accompanying drawings and in particular to FIGS. 1 and 2, the numeral 1 denotes in its entirety a fan unit according to this invention.

The fan unit 1 is preferably destined for automotive applications in the cooling of radiators.

The fan unit 1 comprises an axial fan 2 with an axis of rotation R, an electric motor 3 and an axial flow impeller 4 driven and rotated by the motor 3 about the axis R.

Figure 3:
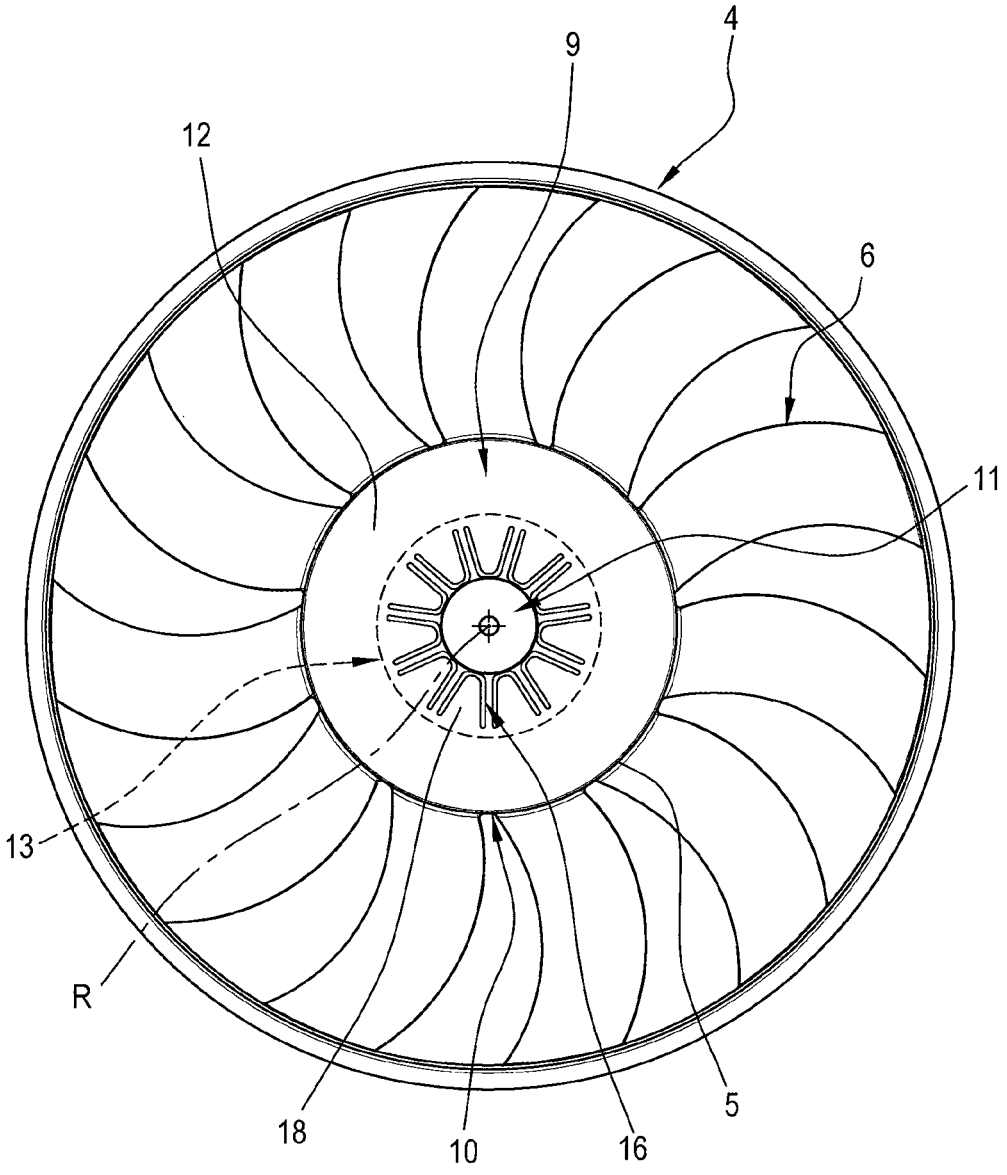
FIG. 3 shows a front view of the axial fan according to the previous drawings and equipped with blades.
Figure 4:
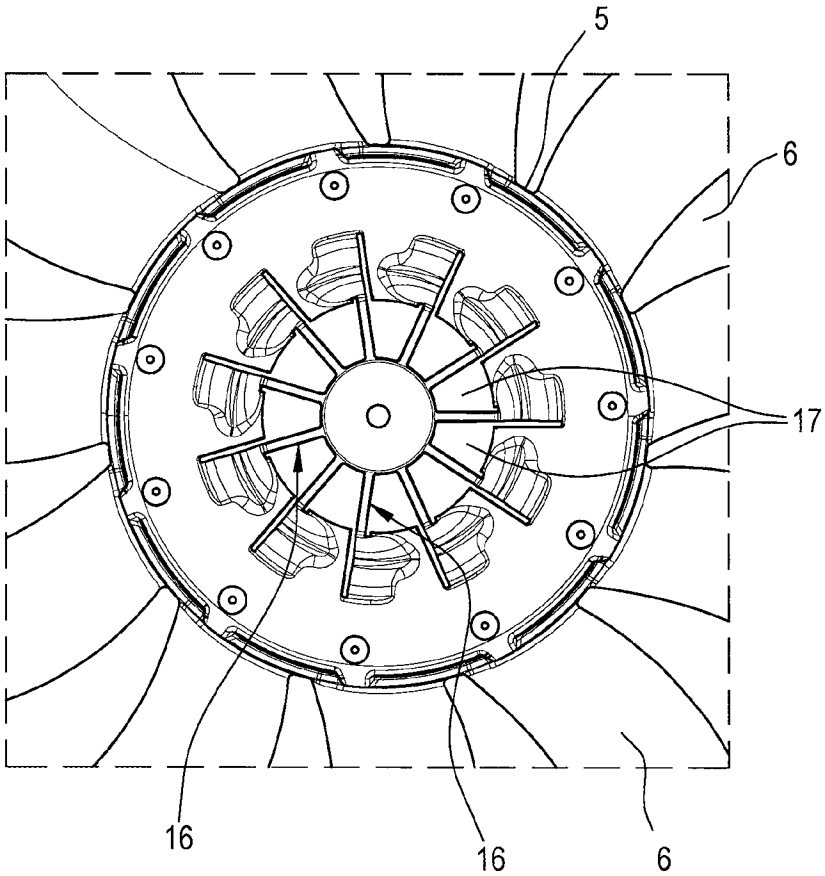
FIG. 4 shows a front view of the axial fan of FIG. 3 with some parts cut away according to an alternative embodiment and for greater clarity.

As illustrated in FIGS. 3 and 4, the fan 4 is equipped with a hub 5 and a plurality of blades 6 which extend from the hub 5.

As illustrated in particular in FIGS. 1 and 2, the motor 3, preferably of the closed and sealed type, substantially of known type and described only insofar as is necessary to understand the invention, comprises an external casing 7 and a shaft 14, coaxial with the axis R, to which the impeller 4 is connected.

The impeller 4 or, rather, the axial fan 2 comprises the above-mentioned hub 5 which is in turn shaped in the form of a cup and comprises a bottom wall 9 and an annular lateral wall 10 for partially containing the electric motor 3.

As illustrated in particular in FIGS. 4, 5, 6 and 7, on the bottom wall 9 of the hub 5 there is a central portion 11, an outer annular portion 12 joined to the annular lateral wall 10 and a intermediate portion 13 for connection between the central portion 11 and the outer annular portion 12.

The central portion 11 is connected to the movable part of the electric motor 3 in such a way that the hub 5 and consequently the fan 6 can be rotated about the axis of rotation R.

As illustrated in FIG. 2, the electric motor 3 is equipped with a shaft 14 connected to the inner rotor and designed to support, at the relative free end, the impeller 4.

More specifically, at the central portion 11 of the bottom wall 9 of the hub 5, there is a sintered steel bushing 15 which allows a stable and robust keying of the hub 5 on the shaft 14 of the motor 3.

The above-mentioned intermediate portion 13 comprises a plurality of blades 16 which extend radially relative to the axis of rotation R towards the above-mentioned outer annular portion 12.

The blades 16 are elasto-plastic blades and each of them has a flat rectangular shape.

Figures 6, 6A:
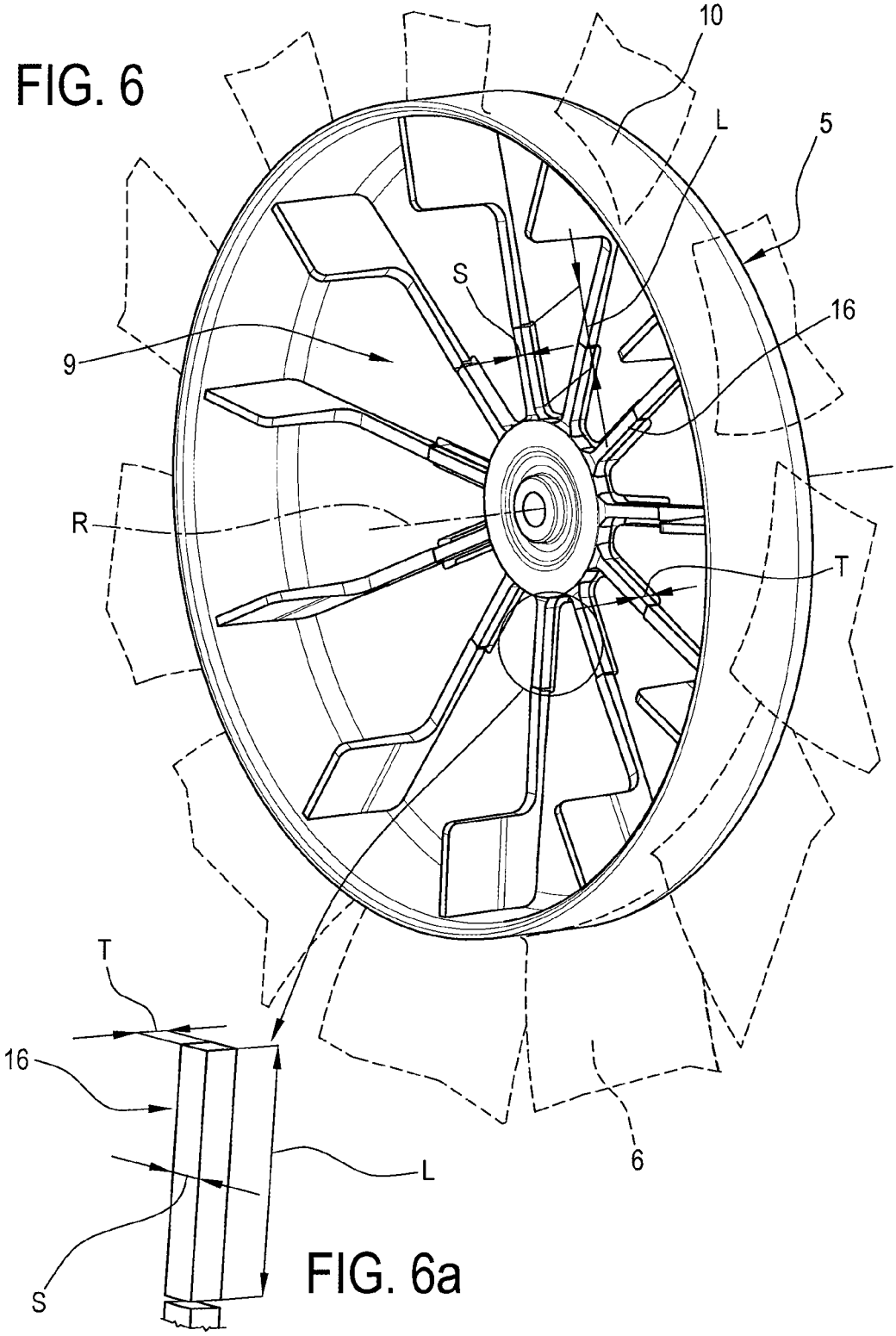
FIG. 6 shows a schematic perspective view of the inner part of the hub of the impeller of the fan of FIG. 1 without the blades.
FIG. 6*a* shows a scaled-up schematic perspective view of a blade of the hub of FIG. 6.

More specifically, as illustrated in FIG. 6*a*, each blade 16 is defined by a longitudinal dimension L which extends radially relative to the axis of rotation R, a transversal dimension T which extends parallel to the axis of rotation R and a thickness S.

Each blade 16 must have its transversal dimension or thickness S much less than its longitudinal dimension L.

Figure 5:
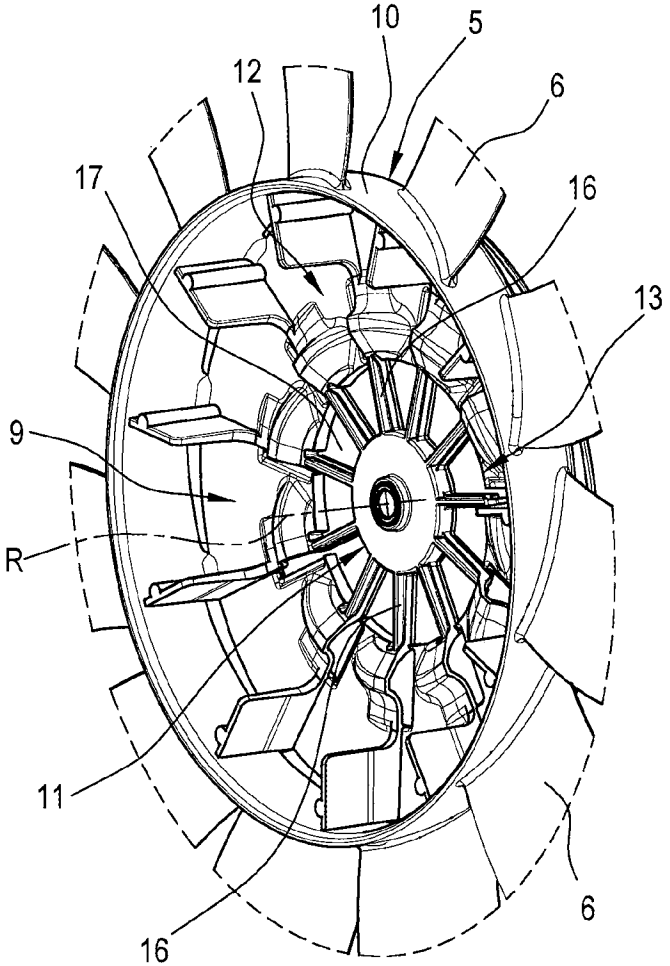
FIG. 5 shows a schematic perspective view of the inner part of the hub of the impeller of the fan of FIG. 4, without the blades.

According to the embodiment illustrated in FIGS. 4 and 5, the blades 16 are angularly separated by an empty space 17.

Figure 7:
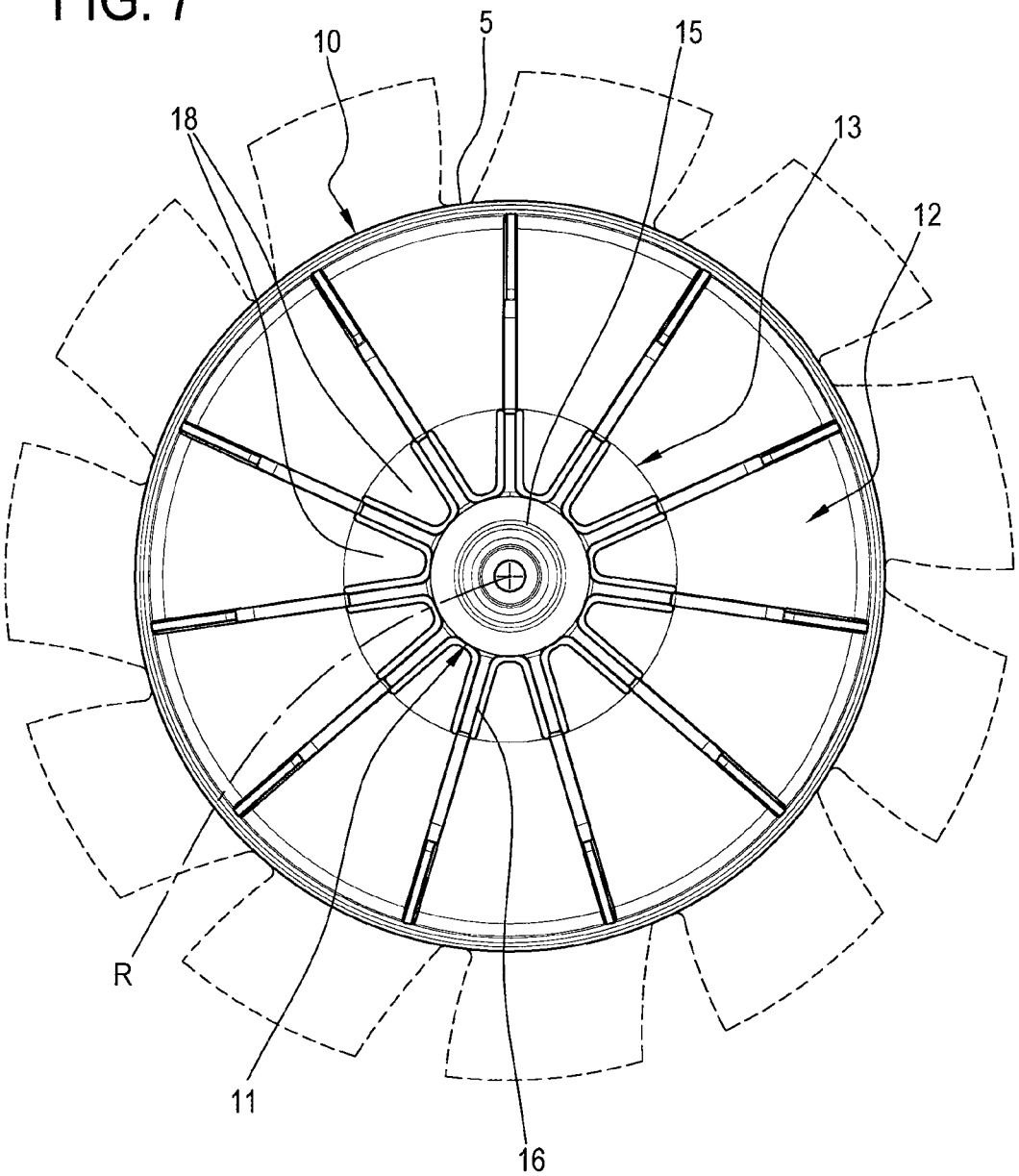
FIG. 7 shows a schematic front view of the inner part of the hub of the fan of FIG. 6, without the blades.

According to the embodiment illustrated in FIGS. 3, 6 and 7, the blades 16 are angularly separated by a tab 18 which is substantially V-shaped for protecting the hub 5.

As illustrated in FIG. 2, between the bottom wall 9 of the hub 5 and a front wall 19 of the motor 3 there is a distance D.

The distance D is the minimum distance which can be obtained in the construction of the electric fan unit 1.

It should be noted that each blade 16 has the relative transversal dimension T substantially equal to the distance D.

Obviously, the transversal dimension T is just less than the distance D to enable the rotation of the hub 5 without sliding on the front wall 19 of the motor 3.

From what is described above it follows that the above-mentioned blades 16 extend with their transversal dimension T parallel to the axis R and to the shaft 14 and with their longitudinal dimension L perpendicular to the shaft 14, whilst they extend with their thickness S along a direction parallel to the direction of rotation of the impeller 4.

In other words, each blade 16 comprises an I-shaped beam the dimensions of which with reduced thickness S with respect to the transversal dimension T and their particular positioning relative to the axis of rotation R of the hub 5 and of the impeller 4 are very resistant to longitudinal loads, that is, along their transversal direction T, very resistant to loads along their longitudinal direction L, whilst they are flexible to loads along their thickness S perpendicular to their larger lateral surface.

The plurality of blades 16 is therefore able to prevent the impeller 4 from moving axially parallel to the axis of rotation R, moving radially perpendicular to the axis of rotation and a bending of the impeller 4 with movements normal to the plane in which the mean surface of the impeller 4 itself lies.

The above-mentioned blades 16 allow, on the other hand, a movement with torsional bending in such a way as to allow damping of the resonance frequencies.

It should be noted that the number of blades depends on the number of the blades of the fan and must be at least sufficient to obtain the minimum effect of annulling the radial and longitudinal movements, and to at least allow damping of the resonance frequencies with torsional bending.

The number of blades provided must be sufficient to obtain these effects of eliminating radial and longitudinal movements and allow the damping of the resonance frequencies with bending.

For this reason, the number of blades may be changed as a function of the result which one wishes to obtain; in particular, the number of blades must be sufficient to guarantee these effects and it will always depend on the ratio between bending torque and twisting torque.

It should also be noted that the blades 16 are made during the step of moulding the impeller 4 and are therefore made of the same material used to make the impeller 4 itself.

This production process does not, therefore, involve the addition of different materials or procedures in addition to that of moulding, allowing the production of the fan to be achieved without additional production costs (that is to say, with substantially reduced costs).

The blades are elasto-plastic structures in the sense that they have both an elastic effect and a plastic effect, with hysteresis cycles during their operation.

Figure 8:
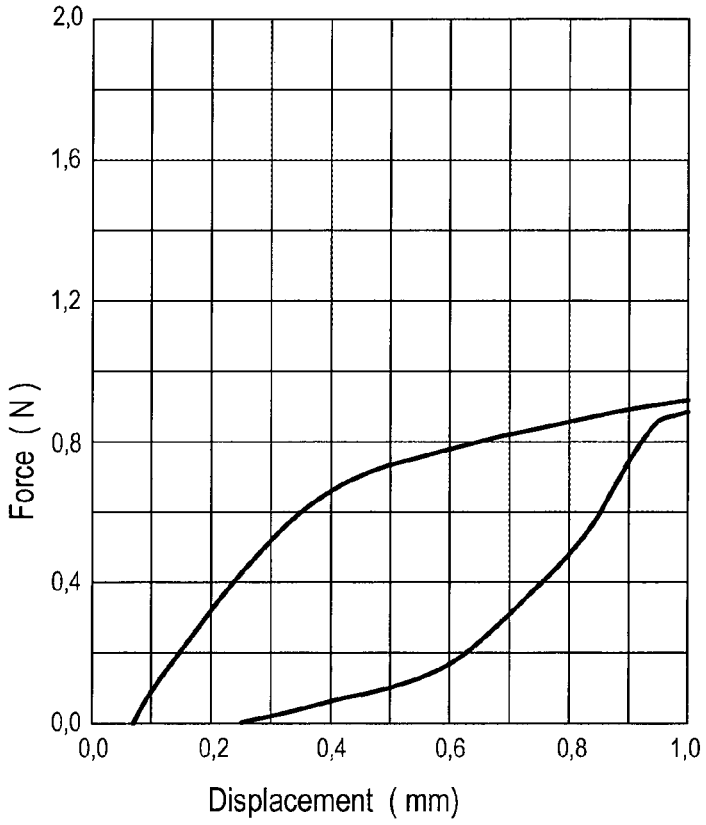
FIG. 8 shows the diagram of the energy absorbed by a blade of the hub of the fan according to this invention.

As illustrated in FIG. 8, when the blades 16 operate they define a hysteresis cycle which corresponds to the absorption of energy and they therefore constitute an actual damper which allows the vibrations caused by the resonance frequencies to be dampened.

The invention claimed is:

1. An axial fan comprising:

an electric motor including a movable part, an impeller including a hub, the hub comprising a central portion connected to the movable part of the electric motor to be rotated about an axis of rotation, the hub also comprising an outer annular portion connected to the central portion by an intermediate portion, wherein the intermediate portion comprises a plurality of elasto-plastic blades arranged radially and angularly distributed about the axis of rotation, each elasto-plastic blade constituting an I-shaped beam defined by:

a longitudinal dimension extending radially relative to the axis of rotation and having a radial axis of extension positioned axially within a thickness of the central portion of the hub, a transversal dimension extending parallel to the axis of rotation, and a thickness being normal to the radial axis of extension and normal to the axis of rotation, the thickness being less than the transversal dimension and the longitudinal dimension to be resistant to loads along the transversal direction and longitudinal direction while being flexible to loads along the thickness such that the elasto-plastic blades:

prevent the impeller from moving axially parallel to the axis of rotation, prevent the impeller from moving radially perpendicular to the axis of rotation, prevent a bending of the impeller with movements normal to a plane in which a radially extending surface of the impeller lies, and allow a movement with torsional bending around the axis of rotation to dampen resonance frequencies of the axial fan.

2. The axial fan according to claim 1, wherein the elasto-plastic blades are angularly separated by an empty space.

3. The axial fan according to claim 1, wherein the hub is cup-shaped and has a bottom wall and a lateral wall to contain at least partly the motor, the central portion, the outer annular portion and the intermediate portion being part of the bottom wall; the outer annular portion being joined to the lateral wall; the central portion comprising a bushing co-molded with the bottom wall for connecting with the movable part of the motor.

4. The axial fan according to claim 3, wherein between the bottom wall of the hub and a front wall of the motor there is a distance, each elasto-plastic blade having the transversal dimension substantially equal to the distance, the difference being sufficient to allow rotation of the hub without sliding on the front wall of motor.

5. The axial fan according to claim 1, wherein the elasto-plastic blades are angularly separated by a tab which is substantially V-shaped for protecting the hub.

6. The axial fan according to claim 1, wherein a number of the elasto-plastic blades is sufficient to obtain the prevention of the radial and axial movements, while allowing the torsional bending to dampen the resonance frequencies.

7. The axial fan according to claim 1, wherein the elasto-plastic blades are made of a same material as the impeller.

8. The axial fan according to claim 1, wherein the elasto-plastic blades are obtained during molding of the impeller.

* * * * *